US006396418B2

(12) United States Patent
Naito

(10) Patent No.: US 6,396,418 B2
(45) Date of Patent: May 28, 2002

(54) TOLL COLLECTION SYSTEM, ON BOARD UNIT AND TOLL COLLECTION METHOD

(75) Inventor: Kazutoshi Naito, Kanagawa-ken (JP)

(73) Assignee: Kabushiki Kaisha Toshiba, Kanagawa-ken (JP)

( * ) Notice: Subject to any disclaimer, the term of this patent is extended or adjusted under 35 U.S.C. 154(b) by 0 days.

(21) Appl. No.: 09/813,131

(22) Filed: Mar. 21, 2001

(30) Foreign Application Priority Data

Mar. 21, 2000 (JP) ..... 2000-078525

(51) Int. Cl.[7] ..... G08G 1/00

(52) U.S. Cl. ..... 340/928; 340/933; 340/937; 340/942; 340/943; 340/905; 235/384; 235/375; 235/383; 705/13

(58) Field of Search ..... 340/928, 933, 340/937, 550, 549, 571, 942, 943, 905; 235/384, 375, 383; 705/1, 13

(56) References Cited

U.S. PATENT DOCUMENTS 5,424,727 A * 6/1995 Shieh ..... 340/928
5,757,285 A * 5/1998 Grabow et al. ..... 340/928
5,760,709 A * 6/1998 Hayashi ..... 340/928
5,955,970 A * 9/1999 Ando et al. ..... 340/928
6,166,659 A * 12/2000 Kusano ..... 340/928
6,317,721 B1 * 11/2001 Hurta et al. ..... 705/13

* cited by examiner

*Primary Examiner*—Daniel J. Wu
*Assistant Examiner*—Tai Tan Nguyen
(74) *Attorney, Agent, or Firm*—Pillsbury Winthrop LLP

(57) ABSTRACT

A toll collection system obtains the data showing that the vehicle enters into the entrance of a toll road and data obtained from the on board unit mounted on the vehicle as the entrance passing data and the data showing that the vehicle exits from the exit of the toll road and the data peculiar to the on board unit mounted on the vehicle obtained by wireless communication with the on board unit as the exit passing data. Furthermore, the system specifies the utilization by the vehicle basing upon the obtained exit passing data and the entrance passing data and also, obtains the data read out from the number plate provided on the vehicle and specifies the vehicle basing upon the data read out from the number plate, when the utilization by the vehicle cannot be specified.

12 Claims, 9 Drawing Sheets

TOLL COLLECTION SYSTEM, ON BOARD UNIT AND TOLL COLLECTION METHOD

FIELD OF THE INVENTION

This invention relates a toll collection system, on board unit and toll collection method used for receiving toll from the side of vehicle applied, for example, to toll gates provided on the toll road.

DESCRIPTION OF THE RELATED ART

In general, as toll receiving systems for the settlement of the toll for the toll road, so-called an open system, in which case the driver prepays the toll for utilizing toll road, and a closed system, in which case the toll is paid later, are used mainly.

The open system is applied for toll roads such as Tokyo Expressway and toll bridges and the like in the Metropolitan area and its suburb. In case of the open system, a certain amount of the toll is collected at the gate when a vehicle passes through to enter the toll road and no toll gate is provided at the exits of the toll roads in general, so that the vehicle may pass as it is.

The closed system is applied, for example, to the express highways for travelling long distance. In this closed system a pass is issued at the entrance gate, through which a vehicle passes for entering the express highway. On the other hand, at the exit gate, through which the vehicle that has utilized the express highway passes for coming to a general street, a bill for the toll corresponding to the travelling distance of the express highways basing upon the registered record in the pass at the entrance of the toll collecting gate and the toll is collected at the exit of the gate.

In the meantime, in the recent years, an introduction of a toll collection system by means of a wireless communication called ETC (Electric Toll Collection) is now under way in order to ease a traffic jam in the vicinity of the toll gate, which has been a weak point of the toll collecting system using such a pass. In this ETC system, a wireless communication function is used and at the same time a vehicle is provided with an on board unit, in which an IC card is removably provided, and a wireless communication is performed between the on board unit and the communication devises located at the entrance and exit gates respectively and the toll is collected.

When ETC system should be introduced into the toll collection system of the prior art using pass (hereinafter called a closed system), vehicles, which are provided with an on board unit, (hereinafter called ETC-vehicles) and vehicles, which are not provided with an on board unit, (hereinafter called non-ETC-vehicles) are mingled and pass through the entrance toll gate and the exit toll gates, it is necessary to perform toll collection available to the respective vehicles.

In other words, in the entrance gate of the toll roads, pass such as a magnetic card is issued to non-ETC-vehicles and in the case of ETC-vehicle, it is so controlled that the entrance gate number and the type of vehicle are stored in the memory of the main body of the on board unit of the ETC-vehicle and in the IC card set in the on board unit. On the other hand, at the exit gate, the pass is taken from the driver of non-ETC-vehicle and the pass reader processes the pass and the toll charge is settled humanly. For ETC-vehicle, the entrance gate number and the type of vehicle are read out from the IC-card of the ETC-vehicle by the communication device provided at the exit gate through the on board unit by wireless. The toll charge is settled automatically basing upon the read out data. As a method for settling the toll charge automatically, IC-card is utilized in a similar way to credit cards or prepaid cards, by correlating the accounting number of the deposit, that the driver has at bank, with the ID-number of the IC-card in advance.

In such a way, the ETC system can be expected to be in future a main current for the toll collection system for the toll roads, when taking it into consideration that convenience through cash-less settlement is elevated and that it is promoted to ease jam in the vicinity of the toll gates.

Therefore, as described beforehand, it is desired to generalize ETC-system in order to ease jam in the vicinity of the tollgates. Then in order to promote the introduction of the ETC-system, it is expected that requirement for new services by an ETC-system are raised additionally, for example, such as a service for reduction of the toll is executed when a travelling distance of a vehicle is less than a specified distance in the toll road that adopts an open system in which a uniform charge must be prepaid.

SUMMARY OF THE INVENTION

An object of the present invention is to provide a toll collection system, an on board unit and the toll collection method, by which the collection of the toll which corresponds to the distance utilized, for example, in a toll road adopting a prepaid method, can be performed quickly and without fail.

In accordance with the present invention, there is provided a toll collection system comprising entrance data obtaining means for obtaining data showing that a vehicle has entered an entrance of a toll road and data obtained from an on board unit mounted on the vehicle by wireless communication as entrance passing data; exit data obtaining means for obtaining data showing that the vehicle has exited from an exit of the toll road and data peculiar to the on board unit obtained by a wireless communication from the on board unit mounted on the vehicle as exit passing data; first vehicle specifying means for specifying a utilization by the vehicle basing upon the obtained entrance passing data and the exit passing data; toll calculating means for calculating toll charge basing upon the specified utilization by the vehicle that is specified by the first vehicle specifying means; means for obtaining data readout from a number plate provided on the vehicle; and second vehicle specifying means for specifying the vehicle basing upon the data obtained from the number plate when the utilization by the vehicle cannot be specified by the first vehicle specifying means.

DETAILED DESCRIPTION OF THE PREFERRED EMBODIMENTS

Figure 1:
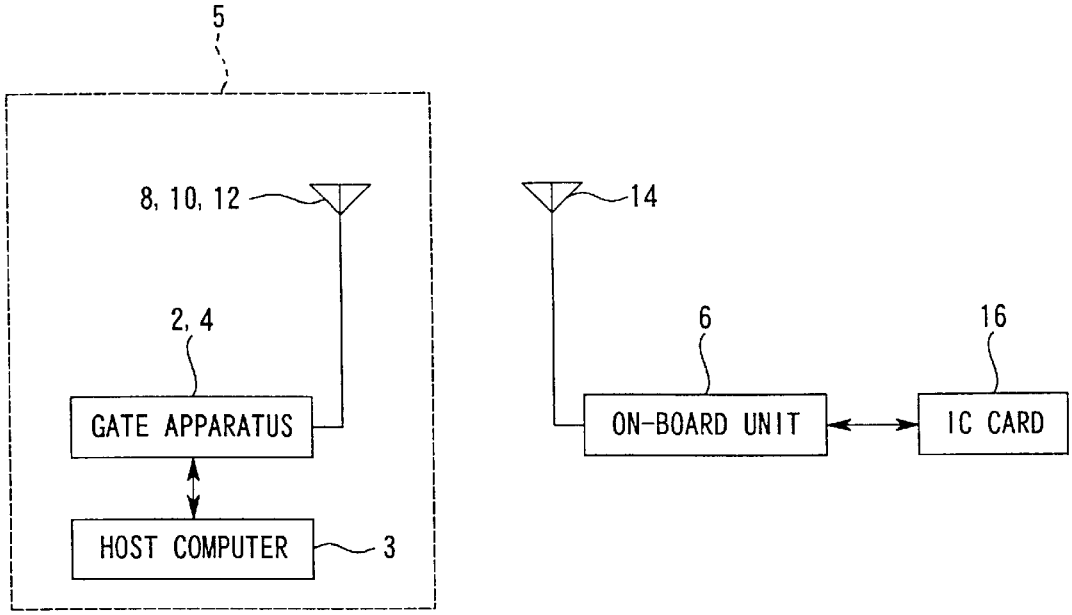
FIG. 1 is a block diagram showing generally an embodiment of the toll collection system of the present invention.

Hereinafter the embodiments of the present invention are described by referring to the drawings.

Figure 2:
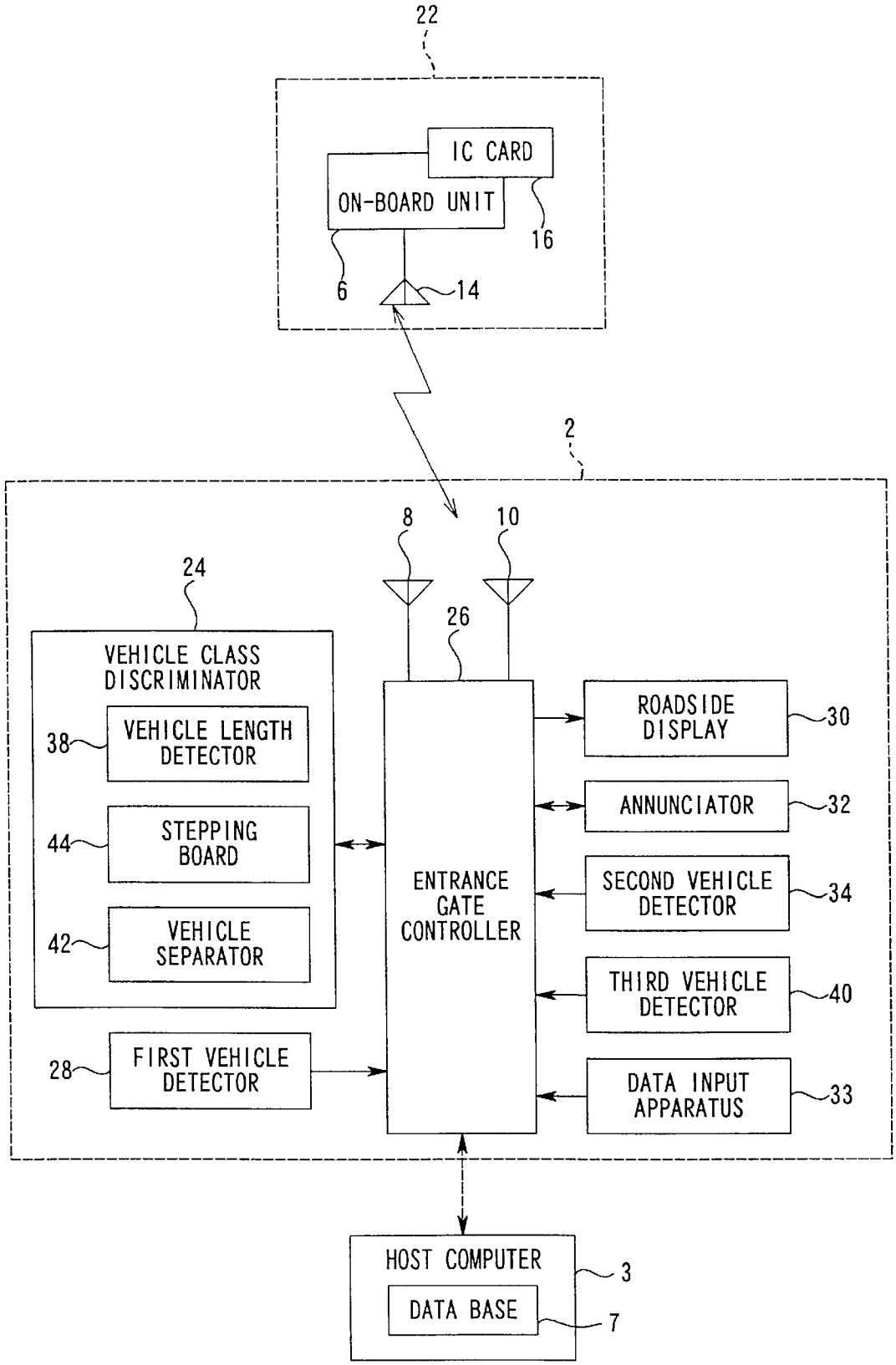
FIG. 2 is a block diagram showing an entrance gate apparatus composing the toll collection system shown in FIG. 1.
Figure 3:
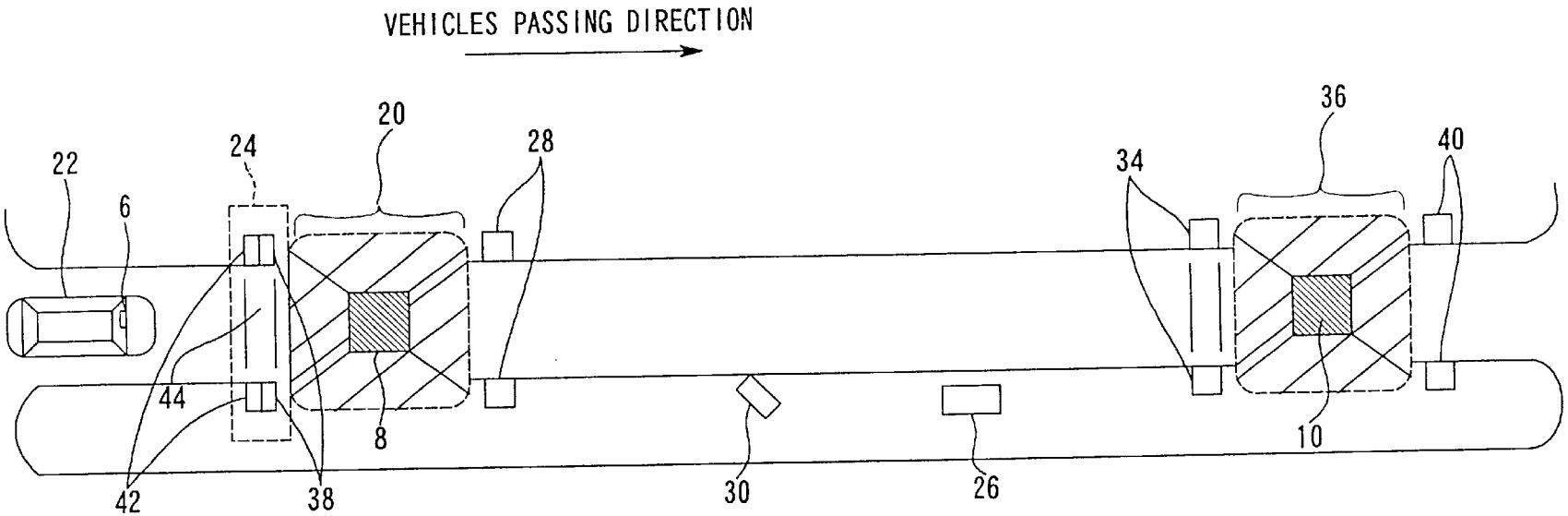
FIG. 3 is a plan view showing generally the entrance gate apparatus shown in FIG. 2.
Figure 4:
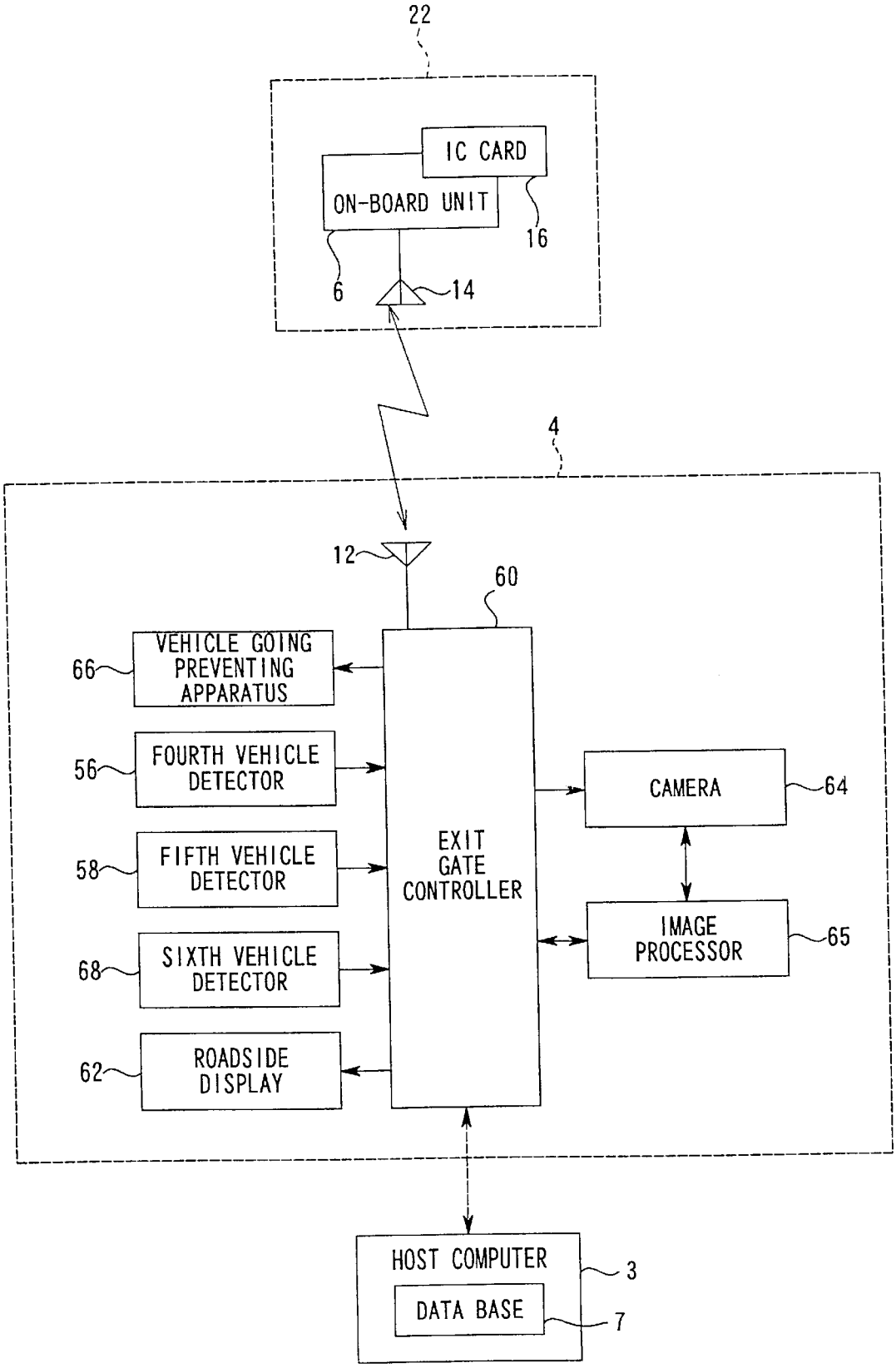
FIG. 4 is a block diagram showing an exit gate apparatus composing a toll collection system shown in FIG. 1.
Figure 5:
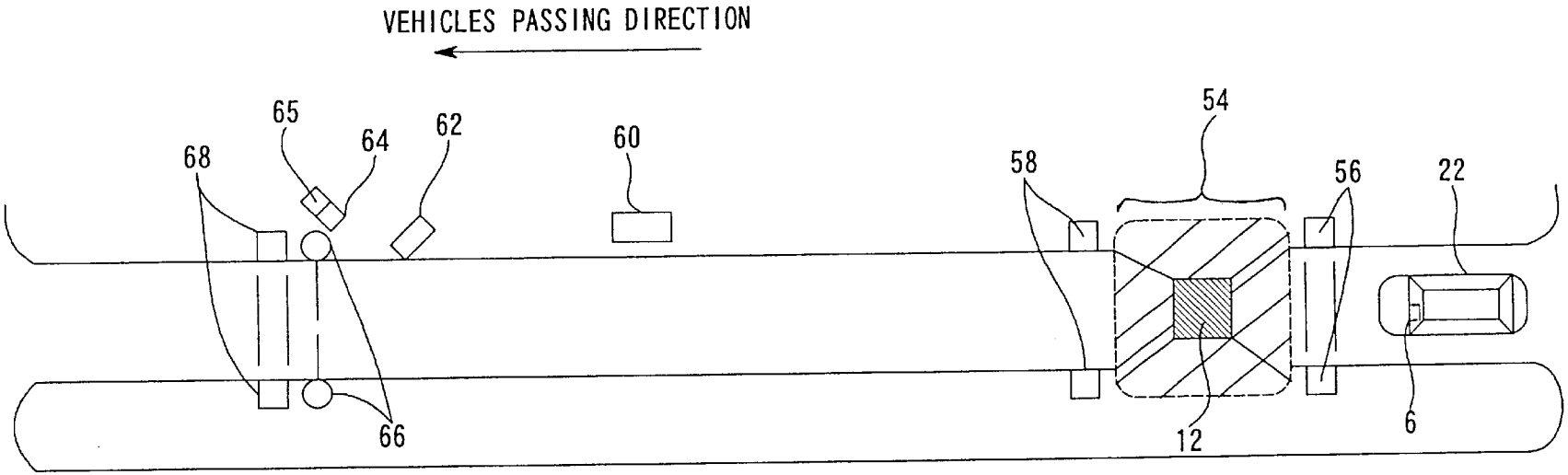
FIG. 5 is a plan view showing generally the exit gate apparatus shown in FIG. 4.
Figure 6:
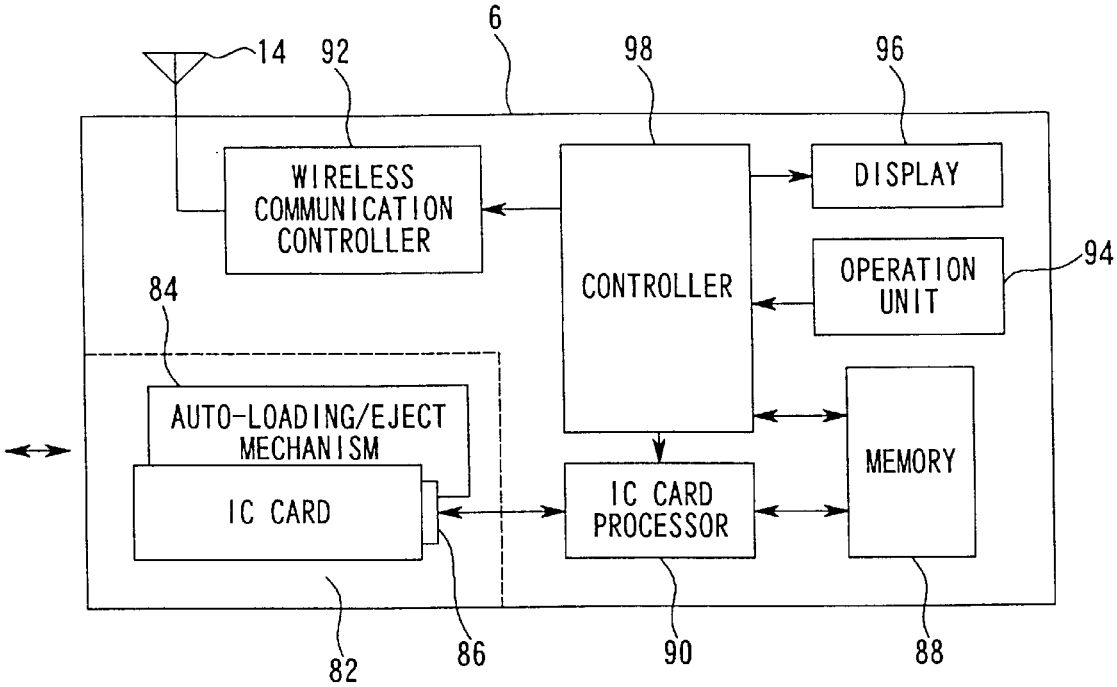
FIG. 6 is a block diagram showing an on board unit composing the toll collection system shown in FIG. 1.
Figure 7:
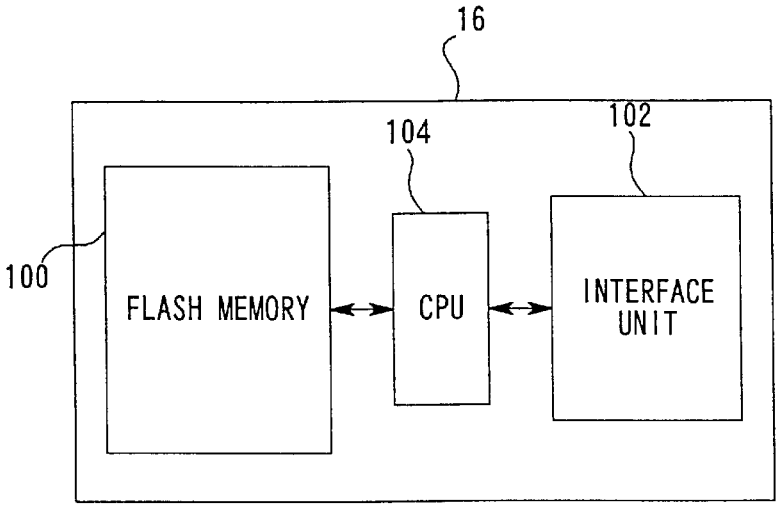
FIG. 7 is a block diagram showing a IC-card to be mounted in the on board unit shown in FIG. 6.

FIG. 1 is a block diagram showing generally an embodiment of the toll collection system of the present invention, FIG. 2 is a block diagram showing an entrance gate apparatus composing the toll collection system shown in FIG. 1, FIG. 3 is a plan view showing generally the entrance gate apparatus showing in FIG. 2, FIG. 4 is a block diagram showing an exit gate apparatus composing a toll collection system shown in FIG. 1, FIG. 5 is a plan view showing generally the exit gate apparatus shown in FIG. 4. FIG. 6 is a block diagram showing an on board unit composing the toll collection system shown in FIG. 1, and FIG. 7 is a block diagram showing a IC-card to be mounted in the on board unit shown in FIG. 6.

This toll collection system is used for the toll road of an open system, in which the toll is to be paid in advance. As shown in FIG. 1, this system comprises gates apparatus 2 and 4 installed at the respective toll gates at the entrance and exit of the toll road and a toll collecting apparatus 5 comprising a host computer, which controls generally a plurality of gate apparatus and is located at the settlement center, and an on board unit to be mounted on a vehicle.

The gate apparatus 2 and 4 are provided with antennae 8, 10 and 12 and a wireless communication regarding the toll collection is performed between these antennae 8,10 and 12 and the antenna 14 provided on the on board unit.

The on board unit 6 is provided with a IC-card 16 and a card stacker with an automatic loading mechanism for receiving or ejecting IC-card 16 automatically. When the user inserts an IC-card 16 into the inlet for the card stacker, the IC-card 16 is automatically received in the card stacker by an automatic loading mechanism. On the other hand, when the card IC-16 is to be taken from the on board unit, the IC-card 16 is automatically ejected from the card stacker, when the user pushes down the ejection button provided on the on board unit.

As to the transmission of the data between the on board unit 6 and the IC-card 16, the data are exchanged through a memory component such as EEPROM, Flash-memory and the like provided in the IC-card 16 and the on board unit proper 6. On the contrary, as to the transmission of the data between the gate apparatus 2 and 4 and the on board unit 6, the data stored in the buffer memories such as RAM provided inside of the respective apparatus are exchanged by wireless.

In this connection, the entrance gate apparatus 2 provided at the toll entrance gate and the exit gate apparatus provided at the toll exit gate are described respectively.

The entrance gate apparatus 2 is provided for each of the lanes of the toll entrance gate at the respective interchanges. The entrance gate apparatus 2 comprises a vehicle class discriminator 24 and an entrance gate controller 26, a first vehicle detector 28, a roadside display 30, a data input apparatus 33, an annunciator 32, a second antenna 10 and a third vehicle detector 40, as shown in FIGS. 2 and 3.

The vehicle class discriminator 24 performs a discrimination of the vehicle classes such as large sized vehicle, normal vehicle, small sized vehicle and the like, by detecting the vehicles entering into the communication area 20 of the first antenna 8 provided at the toll entrance gate one by one.

The entrance gate controller 26 starts to wireless communication through the first antenna 8 and transmits the data such as the number of the toll entrance gate and the time when the vehicle enters the toll entrance gate to the vehicle 22 (ETC-vehicle) which is provided with a on board unit and is able to communicate by wireless, when the vehicle class discriminated by the vehicle class discriminator 24 is transmitted.

The first vehicle class discriminator 28 is installed just before the position, where the vehicle 22 mounted with an on board unit 6 becomes unable to communicate with communication area 20 of the first antenna 8 and informs the entrance gate controller 26 of the detected vehicle 22 as the vehicle that starts from the communication area 20.

The roadside display 30 gives the vehicle 22 instruction for stopping and starting, for example, by lightening red signal or blue signal.

The data input apparatus 33 is used by an attendant in the booth of the toll entrance gate for inputting the data to the entrance gate controller 26.

The annunciator 32 performs specified annunciation for attendants in the booth and the driver in the vehicle 22 by means of audio guidance or visible data display.

The second antenna 10 performs data exchange with the on board unit 6 mounted on the vehicle 22 in the communication area 36, when the vehicle that has finished a normal communication with the first antenna 8 is detected by the vehicle detector 34. For example, the second antenna 10 compares the vehicle class detected by the vehicle class detector 24 with the vehicle class stored in the on board unit 6 that is received from the on board unit 6, and transmits the comparison result to the on board unit 6.

The third vehicle detector 40 detects the vehicle 22 that has passed through the communication area 36 of the second antenna area 10 and starts from the toll entrance gate.

The vehicle class detector 24 comprises mainly a vehicle height and length detector 38, a stepping board 44 and a vehicle separator 42.

The vehicle height and length detector 38 detects the height and the length of the vehicle that passes.

The stepping board 44 is buried under the surface of the road on which the vehicle 22 goes through and detects the number of the axles which connects the left and right tires and the axle distance by a detecting press switch to be pressed by the tires of the vehicle.

The vehicle separator 42 detects the clearance between the vehicles that enter in the toll entrance gate in order to detect the vehicles entering into the toll entrance gate one by one without fail, while the light emitter and the receiver are provided in the opposite sides of the gate lane respectively.

The vehicle class discriminator 24 as composed in the above judges synthetically the vehicle class of the vehicle 22 basing upon the data obtained from the number of the axles that connects the left and right tires of the vehicle 22, vehicle width, width of tire, vehicle height, vehicle length and the like and inform the toll entrance gate controller 26 of the same.

The entrance gate controller 26 transmit the data on the vehicle including the ID-number peculiar to the on board unit 6 stored in the on board unit in advance, the registered number of the vehicle 22, data of the number plate, data of the vehicle class, which have been obtained by wireless, the date and time when the vehicle 22 is detected by a third vehicle detector 40 (The date and time when the vehicle 22 has passed the toll entrance gate) or the date and time when the toll collection is processed by wireless, the number of the toll gate peculiar to the toll gate to the host computer 3. The host computer 3 stores these received data as the processed entrance data (the entrance passing data) in the database.

Next, the exit gate apparatus 4 is described. The exit gate apparatus is provided for each of the lanes of the toll exit date at the respective interchanges. The exit gate apparatus 4 comprises a fourth vehicle detector 56, an exit gate controller 60, a roadside display 62, a camera 64, an image processor 65, a vehicle going preventing apparatus 66 and a sixth vehicle detector 68, as shown in FIGS. 4 and 5.

The fourth vehicle detector 56 detects the vehicles 22 that enter into the communication area 54 of the third antenna 12 one by one.

The exit gate controller 60 exchanges the data regarding the toll collection with the on board unit 6 mounted in the vehicle 22 through the third antenna 12, when the vehicle 22 is detected by a fourth vehicle detector 56. Also, the exit gate controller 60 judges whether the vehicle 22 is an ETC-vehicle with which communication is possible or a non-ETC-vehicle with which communication is impossible, depending upon whether or not the data regarding the toll collection can be received, before the going vehicle 22 is detected by a fifth vehicle detector 58.

A camera 64 takes a picture of the number plate attached to the front of the vehicle 22.

An image processor 65 processes the image of the number plate taken by the camera 64 and detects the registered number of the vehicle 22.

A vehicle going preventing apparatus 66 prevents the vehicle 22 from going straight to a general street from the toll exit gate.

A sixth vehicle detector 68 detects the vehicle 22 starting from the toll entrance gate.

An exit gate controller 60 transmits the data obtained by a wireless communication, the registered number of the vehicle 22 (data of number plate), the date and time when the vehicle 22 has passed the toll exit gate and the number of the toll gate peculiar to the toll gate to the host computer 3.

The data of the vehicle involves the ID-number of the on board unit peculiar to the on board unit 6 that is stored in the on board unit in advance, the registered number of the vehicle 22 and the data of class of the vehicle 22.

The registered number of the vehicle 22 (the data of the number plate) is obtained from the number plate which picture is taken by the camera 64.

The date and time when the vehicle 22 has passed the toll exit gate is the date and time when the vehicle 22 is detected by the sixth vehicle detector 68.

The host computer 3 stores these received data as the exit processed data (the exit passing data) in the data base 7.

Next, the on board unit 6 is described. The on board unit 6 comprises an auto-loading/ejecting mechanism 84, an interface 86of the IC-card 16, an IC-card processor 90, a wireless communication controller 92, an operation unit 94, a display 96 and a controller 98.

The auto-loading/ejecting mechanism 84 is to load an IC card 16 in a card stacker 82 and to eject an IC-card 16 in the card stacker 82.

An IC card processor 90 is to process the data read out through the interface 86 and to store the result of the processing in a memory 88.

A wireless communication controller 92 is to transmit the data stored in the memory 88 through an antenna 14 mounted on the vehicle and to store the data received by the antenna 14 mounted on the vehicle in the memory 88.

An operation unit 94 is provided with ten-keys, appointing key, execution key, eject button and the like.

A display 96 is provided with a letter display guiding how to operate and LED lamps and the like.

A controller 98 controls all the portions synthetically.

In the memory 88 the data regarding the vehicle are stored in advance. The data regarding the vehicle includes the length, the height of the vehicle, number of the axles, the weight, the usage, the special features and the like of the vehicle 22, and also the class of the vehicle 22, the ID-number of the on board unit peculiar to the on board unit, as well as the registered number of the vehicle 22.

An IC card 16 is provided with a flash memory 100, an interface 102 that performs data exchange with the interface 86 of the on board unit 6, a CPU 104 which controls the interface 102 and the flash memory 100, as shown in FIG. 7. In the flash memory 100 of the IC card 16, the number of account of the users deposit, data for a special contract showing the propriety of a discount for the physically handicapped, and the data regarding the settlement including the term of validity and the like are stored. Furthermore, the ID number for identifying the IC card 16 is stored in the flash memory 100 of the IC card 16 in advance, and the traffic record such as the date and time when the vehicle passed, the toll gate number for identifying the toll gate, the vehicle class of the vehicle 22 and the balance amount the card and the like are stored in relation with the ID number, when the vehicle 22 passes the toll entrance gate. Also, when the IC card 16 is inserted on the on board unit 6, for the first time after the on board unit is justified through the signal communication with the on board unit 6, the data for the settlement is transmitted to the on board unit 6.

Next, basic behavior of the toll collecting system according to the embodiment of the present invention is described, when the vehicle 22 passes the toll entrance gate and the toll exit gate.

At first, the action when the vehicle 22 pass the toll entrance gate is described. When the vehicle 22 enters into the communication area 20 of the toll entrance gate, the vehicle 22is detected by the vehicle class discriminator 24 and the vehicle class is discriminated. The toll entrance gate controller 26 that has received the vehicle class of the discriminated vehicle 22, starts to inquire for a communication with the vehicle 22 by controlling a first antenna 8. In case that an on board unit is mounted on the vehicle 22, when the on board unit 6 recognizes that it is a justified enquiry from the first antenna 8, the on board unit answers and transmit the data for the settlement informed by the IC card 16, the registered number of the vehicle 22 and the data of class of the vehicle 22 among the data stored in advance. Thew toll entrance gate controller 26 that has received this answering signal, confirms the term of the validity for the settlement data and that the balance of the deposit is not zero.

When the specified conditions are satisfied as the result of the confirmation, the toll gate number of the entrance gate is transmitted to the on board unit 6. When the on board unit 6 confirms that the communication has been performed normally, the on board unit transmits an information of the finish of reception to the first antenna 8.

When the ETC-vehicle 22 passes the side of the entrance gate controller 26 and enters into the communication area 38, the result of the discrimination is transmitted from the vehicle class discriminator at this moment, and the detection signal of the vehicle 22 is transmitted from the second vehicle detector 34 to the toll entrance gate controller 26. The toll entrance gate controller 26 that has received this detection signal executes a communication and an inquiry with the on board unit 6 by controlling a second antenna 10.

When the on board unit 6 recognizes that the communication and inquiry are justified, the card ID number that is advised by the IC card 16 and the ID number of the on board unit that is registered in the on board unit 6 in advance are transmitted as a response signal. The entrance gate controller 26 that has received this response signal confirms the justification of the card ID number and the ID number of the on board unit which is response signal.

When the entrance gate controller 26 confirms the justification of the respective ID numbers, the entrance gate controller 26 compares the vehicle class judged by the vehicle class discriminator with the data of the vehicle class that is stored in the on board unit, and when these agree with, the toll charge to be imposed to the vehicle 22 is calculated basing upon the vehicle class. If the vehicle class discriminated by the vehicle class discriminator does not agree with the data on the vehicle class stored in the on board unit, a vehicle class with abnormal flag is recorded, and this abnormal flag is transmitted to the host computer and is sent back to the on board unit at the same time. The data on the imposed toll is sent back to the on board unit through the second antenna 10, so that this calculated toll charge is paid by the vehicle 22, and the same effect is transmitted to the host computer 3. When the on board unit 6 receives the data on the imposed toll through the second antenna 10, the on board unit informs the second antenna 10 of the reception of the information of the imposed toll and at the same time stores the received data on this imposed toll, the aforementioned entrance gate number and the result of the discriminated vehicle class in the IC card 16.

Thereafter, the vehicle 22 goes straight on for entering into a driving lane in the toll road and is detected by a third vehicle detector 40. Then, the entrance gate controller 26 transmits the ID number peculiar to the on board unit 6 stored in the on board unit 6 in advance that is obtained by wireless, the registered number of the vehicle 22, the data on the vehicle including the vehicle class of the vehicle 22, the date and time, when the vehicle 22 is detected by a third vehicle detector 40 (the date and time when the vehicle 22 has passed the entrance gate) and the toll gate number peculiar to the toll gate to the host computer 3.

The host computer 3 stores these data as the data processed at the entrance (the entrance passing data) in the data base 7.

Next, the basic function, when the vehicle 22 pass the toll exit gate is described. When the vehicle 22 entering into the communication area 54 in the toll exit gate is detected by a fourth vehicle detector 56, the data (information) is transferred to the exit gate controller 60. The exit gate controller 60 starts to inquire to the vehicle 22 by controlling the third antenna 12. When the on board unit 6 receives the signal of the inquires, the on board unit 6 checks the justifiability of the signal of inquiries. Then, when the signal of inquiries is justified, the on board unit 6 transmits the replies on the data on the vehicle including the ID number peculiar to the on board unit 6 which is stored in the on board unit 6 in advance, the registered number of the vehicle 22 and the vehicle class, the toll imposed at the entrance gate and the toll gate number of the entrance gate and the result of the vehicle class discrimination to the third antenna 12.

The exit gate controller that has obtained these data through the third antenna starts the adjustment processing of the toll charge. In other words, the adjustment processing of the toll charge is to provide a reduction service, when the travelling distance is less than a certain distance and whether or not the vehicle 22 is the subject for the reduction is judged at first basing upon the distance between the entrance gate and the exit gate, namely, the gate numbers of the entrance and exit gates. When the vehicle 22 is the subject for the reduction, the exit gate controller 60 searches the ID number same as the ID number that is received from the on board unit 6 at the exit gate in the processed entrance data of the data base 7 in the host computer 3. In this connection, the registered number of the vehicle 22 related with the same ID number of the on board unit is compared with the registered number of the vehicle 22 received from the on boars unit 6 a the exit gate, and the verification of the date and time when the vehicle 22 has passed the entrance gate in the data base 7 and the present time is performed. Also the justification of the result of the vehicle class discrimination (whether or not the vehicle class with discrimination abnormal flag is existing).

When the justification of the vehicle subject to the reduction is confirmed by the verification of the date and time passing gates and the comparison of registered number, the exit gate controller 60 calculates the reduced toll charge basing upon the vehicle class data stored in the on board unit 6 which is received from the vehicle 22 and the distance between the entrance and exit toll gates. The data on the imposed toll for paying back this calculated toll to the vehicle 22 substantially is transmitted back to the on board unit 6 and is also transmitted to the host computer 3. When the on board unit 6 receives the information on the imposed toll through the third antenna 12, the on board unit 6 informs the third antenna 12 of the end of the reception and at the same time stores the received information on the imposed toll in the IC card 16. Meantime, when the vehicle 22 is judged as a vehicle not subject to the reduction, the vehicle going preventing apparatus opens and the going permission is given immediately.

Thereafter, the vehicle 22 goes straight to a general street, and when the vehicle 22 is detected by a sixth vehicle detector 68, the exit gate controller 60 transmits the information including the ID number of the on board unit 6 peculiar to the on board unit 6 which is stored in the on board unit in advance, the registered number of the vehicle 22, the vehicle class of the vehicle 22, which are obtained by wireless, and the date and time, when the vehicle 22 is detected by a sixth detector 68 (the date and time when the vehicle 22 has passed the exit toll gate), or the date and time when the toll charge collection process is performed by wireless, and the toll gate number peculiar to the toll gate to the host computer 3. The host computer 3 stores these data as the processed exit data (the exit passing data) in the data base 7.

Figure 8:
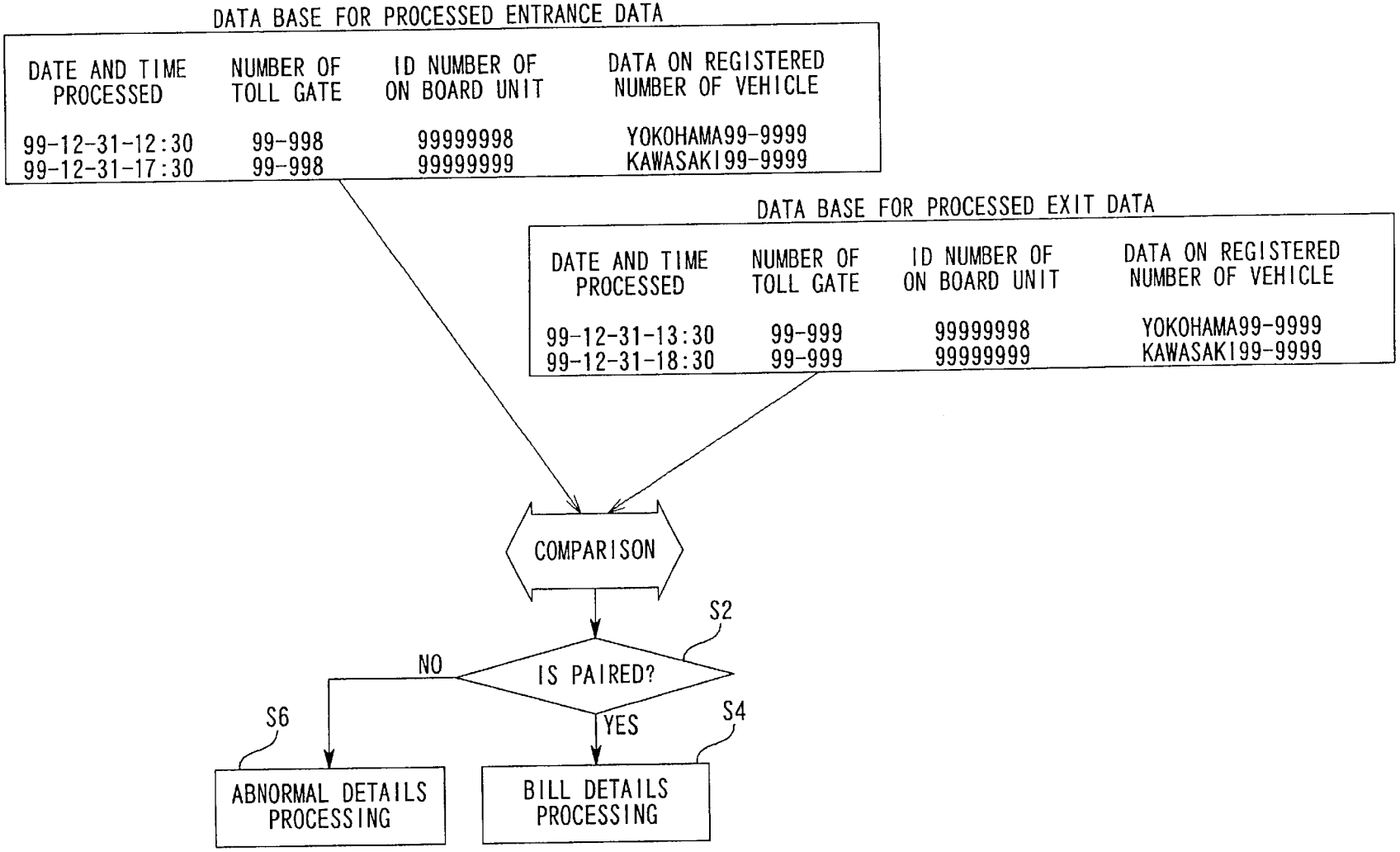
FIG. 8 is a flow chart showing a main toll imposing process in relation with the reduction to be executed by the toll collection system shown in FIG. 1.
Figure 9:
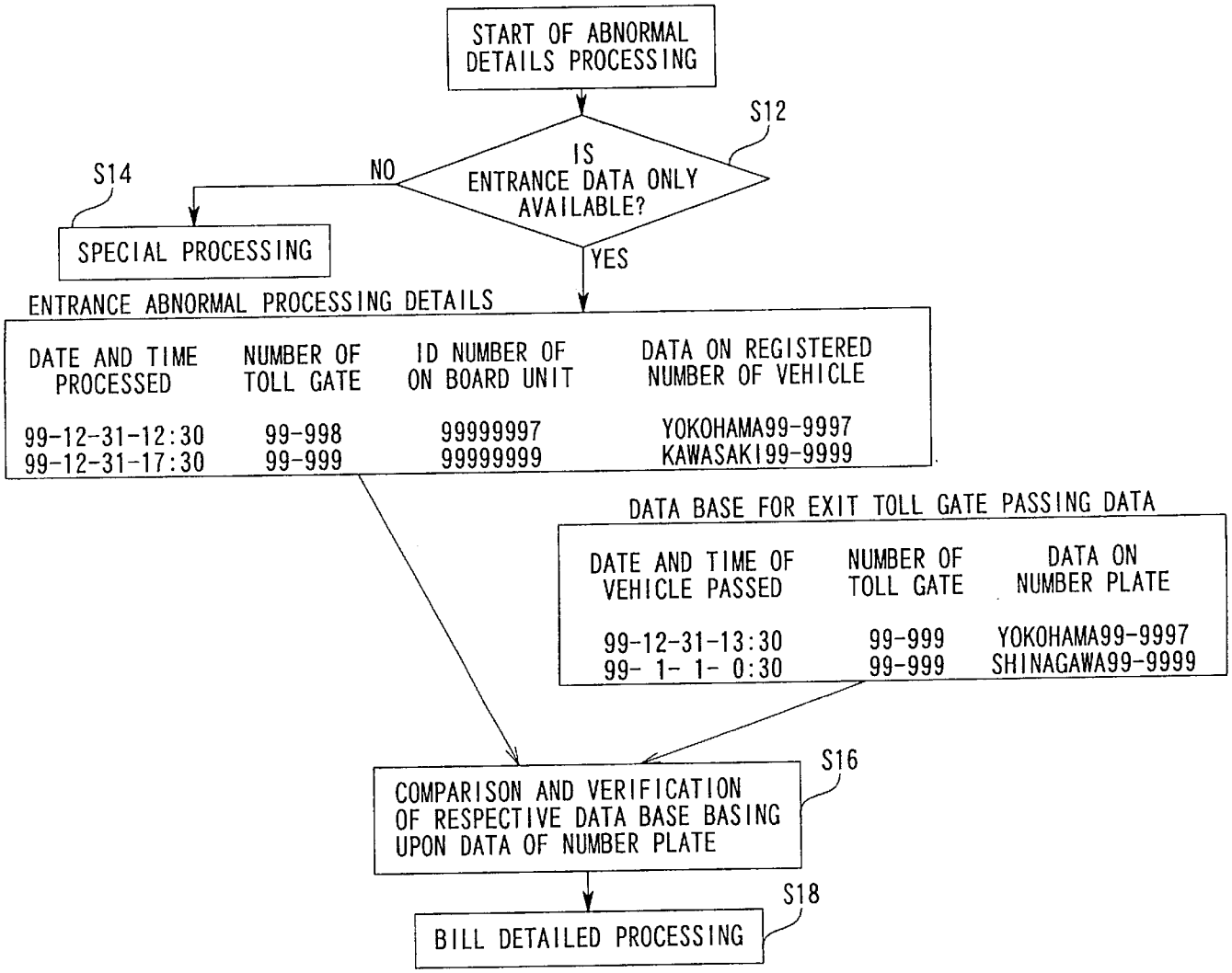
FIG. 9 is a flow chart showing an abnormal details process as one of the toll charging processes shown in FIG. 8.
Figure 10:
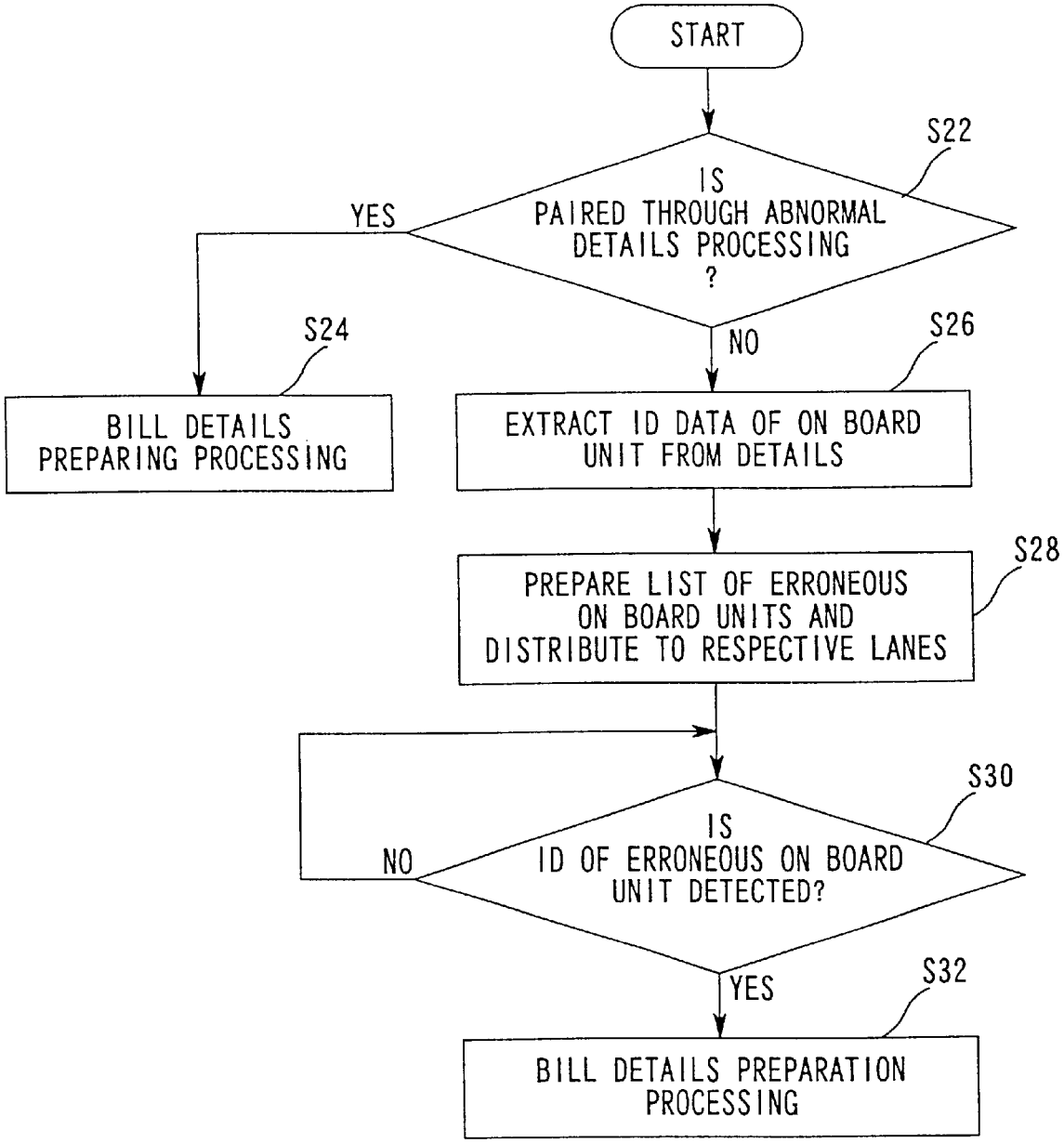
FIG. 10 is a flow chart showing the final processing for the abnormal detailed process shown in FIG. 9.

Furthermore, the toll charge imposing process regarding the aforementioned reduction service, which is performed by the host computer 3 in the toll collection system according to the embodiment of the present invention, is described by referring to the flow charts shown in FIGS. 8 to 10.

As described in the above, after the vehicle 22 enters into the toll road through the toll entrance gate and exits to a general street through the toll exit gate, the host computer 3 searches whether or not the data having the same ID number of the on board unit exists in each of the processed entrance data and the processed exit data stored in the data base 7 (whether or not the data are paired) (S2). At this moment, the host computer 3 performs at the same time a justification of the time difference between the respective toll collection processes at the respective toll gates basing upon the estimated travelling time between the entrance and exit gates. When the data having the same ID number of the on board unit and its justification is confirmed, the distance utilized by the vehicle 22 and the toll utilized is determined basing upon theses data (YES of S2). Basing upon the searched data a detailed billing process for drawing the toll amount from the deposit in the user's bank and the like is performed.

On the other hand, when the data not having the same ID number of the on board unit exists in each of the processed entrance data and the processed exit data stored in the data base 7 (NO of S2), an abnormal billing process is performed (S6).

In other words, this abnormal invoicing process is prepared in consideration of the case that the vehicle subject to the reduction passes the toll exit gate without receiving the reduction service due to a communication disturbance around the toll exit gate, or a failure of the camera 66 that takes a picture of the number plate, and as shown in FIG. 9, at first, it is queried whether or not the data not having the same ID number of the on board unit are the data that exist in the processed entrance data (S12). At this moment, the data not having the same ID number of the on board unit exist in the processed exit data (NO of S12), there is a possibility that the vehicle in question may not have been imposed by toll, the vehicle is handled for a special process (S14), a research is executed manually basing upon the ID number of the on board unit and the registered number of the vehicle 22 and the like.

On the other hand, the data not having the same ID number of the on board unit are found in the processed exit data (YES of S12), the data of this processed exit information is listed up as the entrance abnormal processed details and the toll exit gate passing data that the vehicle has passed the exit gate without executing a wireless communication (the data without the ID number of the on board unit 6 received from the on board unit and the registered number of the vehicle) are listed up. Thereafter the data having the same registered number as the registered number of the vehicle 22 which has been obtained from the number plate of the vehicle 22 in the toll exit passing data (number plate information) are searched in the entrance abnormal processed details (S16). When the data having the same registered number is searched, aforementioned billing details process (including the reduction process) is executed (S18).

Furthermore, as shown in FIG. 10, as described in the above, the respective data at the entrance and the exit are paired (YES of S22), though an billing details process is executed (S24), when the respective data at the entrance and the exit are not paired (NO of S22), the ID number of the on board unit, which registered number has not coincided, is extracted from the entrance abnormal processed details (S26). Furthermore, a list of erroneous on board unit is prepared basing upon the ID numbers of the extracted on board units and this ID number is distributed to the respective toll gates as the erroneous on board unit (S28). Thereafter, for example, when at an certain entrance gate, an erroneous ID number of the on board unit is detected by the entrance gate controller 26 (YES of S30), an advice is performed to the attendants at the booth or to the driver of the vehicle 22 by means of an audio information or visible display through the annuciator 32. By such an arrangement, as, for example, the attendant in the booth can ask the driver of the vehicle that is mounted with the on board unit for the reason, that the attendant may input the information regarding the toll collection which could not be obtained at the toll exit gate last time, into the toll exit gate controller 26 through the data input apparatus 33, and accordingly, billing details process as aforementioned (including the aforementioned reduction process) can be performed (S32).

As described in the above, in the toll collection system in accordance with the embodiment of the present invention, the toll once imposed on the vehicle 22 at the time of passing the toll entrance gate can be reduced after the vehicle 22 has passed the exit gate basing upon the toll gate numbers at entrance and exit of the toll road, in other words, basing upon the travelling distance from the toll entrance gate to the toll exit gate.

Therefore, according to the toll collection system, for example, in the case of toll road that adopts an open system in which a uniform charge is to be prepaid, the toll collection in accordance with the travelling distance, in other words, reduction in accordance with the travelling distance can be realized quickly and without fail, when the travelling distance of the vehicle is less than a certain distance.

Furthermore, in accordance with the toll collection system, the aforementioned reduction of toll charge can be executed without fail, basing upon the evaluation result of the justification of the ID number of the on board unit of the vehicle 22 that has been obtained from the on board unit at the time of passing the toll entrance gate and the toll exit gate, the registered number of the vehicle 22 and the data on the vehicle class of the vehicle 22, and the result of the judgement of the justification of the travelling time from the toll entrance gate to the toll exit gate.

Also, according to the toll collection system according to the embodiment of the present invention, even when the information of the vehicle such as the ID number of the on board unit could not be obtained from the on board unit due to the communication disturbance, the registered number can be obtained from the number plate, and the evaluation of the justification of the data when passing the toll gates at the entrance and the exit can be executed surely, a proper amount of the toll according to the travelling distance including the aforementioned reduction can be collected.

Furthermore, according to the toll charge collection system according to the embodiment of the present invention, even when the vehicle that is subject to the reduction of the toll charge of the toll road has passed the toll exit gate without receiving a reduction service due to a communication disturbance around the toll exit and an reading failure of the number plate, as the ID number of the vehicle (list of erroneous on board unit list) is distributed to the respective entrance gate, for example, when the vehicle is going to travel the same toll road and enters the toll entrance gate again, the abnormal details registered in the data base of the host computer 3 is referred and the vehicle is able to receive the reduction service.

Though the embodiment of the present invention is described in details in the above, the invention is not limited to the aforementioned embodiment and any modification is possible as far as the intention of the invention is not deviated. For example, in the above embodiment a case that a toll road of an open system, in which toll is prepaid, is applied with a toll collection system of the present invention is described, a toll road of the closed system in which toll charge is paid after can be also applied with the toll collection system of the invention.

In this case, for example, a minimum toll charge is imposed on the vehicle at the toll entrance gate in advance and when a necessity arises that an additional charge over the minimum charge has to be collected, the toll charge increased by a short amount can be imposed on the vehicle.

Also, though in the above embodiment of the present invention, the description of the toll collection for the non ETC-vehicle (the vehicle not mounted with a on board unit) is eliminated, the system may be so composed that in case that non-ETC-vehicle travels on the toll road that is applied with a toll collection system of the present invention, a uniform charge is collected by cash or by a prepaid card manually and at the same time, a pass printed with a toll entrance gate number is issued to the vehicle, and when the non ETC-vehicle subject to the reduction is passing the toll exit gate, the charge calculated basing upon the entrance gate number printed on the pass can be returned to the driver of the vehicle by cash.

As described in the above, in the present invention, toll charge is imposed on the vehicle basing upon the data regarding the entrance when the vehicle enters into the entrance of the toll road and the entrance passing data composing data obtained for the on board unit at the time of the entrance, and the once imposed toll charge is changed basing upon the travelling distance of the vehicle by specifying the same vehicle passing the entrance and exit gates basing upon the data regarding the exit gate and the exit passing data which are obtained from the on board unit when the vehicle goes out from the exit.

Therefore, according to the present invention, for example, in a toll road in which an open system that a uniform toll charge is to be prepaid is adopted, when the travelling distance is less than a specified distance, the collection of the toll charge corresponding the travelling distance, in other words, reduction corresponding to the travelling distance can be executed quickly and without fail.

Also, according to the present invention, basing upon the data peculiar to the on board unit obtained from the on board unit at the time when passing the entrance and the exit of the toll road, for example, as the once imposed toll charge imposed at the time passing the entrance of the toll road can be changed after the vehicle passes the exit of the toll road, in case of a toll road of the closed system at which the toll charge has to be prepaid, the toll charge corresponding to the travelling distance can be collected quickly and without fail.

Furthermore, according to the present invention, at the time of passing the entrance and exit of a toll road, for example, even when the identification data peculiar to the on board unit could not be obtained for an on board unit due to a communication disturbance and the like, the same vehicle that has passed the entrance and exit can be specified basing upon the data of the registered number obtained from the number plate, for example, as the toll charge once imposed on the vehicle at the time passing the entrance can be changed after the time passing the exit, by this way, in the case of toll road of a toll prepaid system, a proper toll corresponding the travelling distance can be collected.

Moreover, when there are plural of routes from an entrance to an exit, the route in which a vehicle used can be judged by detecting a registered number from a number plate in a course point. By the ability judging the route in which the vehicle used, discount service to the user using for example, the specific route can also be performed.

Also, according to the present invention, even when the vehicle subject to the reduction of the toll charge passed the exit of the toll road without receiving a reduction service due to a communication disturbance around the exit toll gate or due to abnormal reading of the number plate, when the vehicle enters the entrance of the toll road for travelling the toll road, the data for the abnormal cases are referred to and a reduction service can be provided for the vehicle.

What is claimed is:

1. A Toll collection system comprising:

entrance data obtaining means for obtaining data showing that a vehicle has entered an entrance of a toll road and data obtained from an on board unit mounted on the vehicle by wireless communication as entrance passing data;

exit data obtaining means for obtaining data showing that the vehicle has exited from an exit of the toll road and data peculiar to the on board unit obtained by a wireless communication from the on board unit mounted on the vehicle as exit passing data;

first vehicle specifying means for specifying a utilization by the vehicle basing upon the obtained entrance passing data and the exit passing data;

toll calculating means for calculating toll charge basing upon the specified utilization by the vehicle that is specified by the first vehicle specifying means;

means for obtaining data readout from a number plate provided on the vehicle; and second vehicle specifying means for specifying the vehicle basing upon the data obtained from the number plate when the utilization by the vehicle cannot be specified by the first vehicle specifying means.

2. A system as claimed in claim 1, wherein the second vehicle specifying means includes:

means for preparing abnormal cases details including a data peculiar to the on board unit that is obtained from one of the exit passing data and the entrance passing data and transmitting the abnormal cases details to the entrance data obtaining means when the vehicle cannot be specified basing upon the data obtained from the number plate.

3. A toll collection method comprising the steps of:

obtaining data showing that a vehicle has entered an entrance of a toll road and data obtained from an on board unit mounted on the vehicle by wireless communication as entrance passing data;

obtaining data showing that the vehicle has exited from an exit of the toll road and data peculiar to the on board unit obtained by wireless communication from the on board unit mounted on the vehicle as exit passing data;

specifying a vehicle basing upon the obtained entrance passing data and the exit passing data;

calculating toll charge basing upon the exit passing data and the entrance passing data;

obtaining data readout from a number plate provided on the vehicle; and specifying the vehicle basing upon the data obtained from the number plate when the vehicle cannot be specified by the data peculiar to the on board unit included in the exit passing data and the entrance passing data.

4. A method as claimed in claim 3 further comprising the step of;

preparing abnormal cases details including a data peculiar to the on board unit that is obtained from one of the exit passing data and the entrance passing data and transmitting the abnormal cases details to the entrance of the toll road when the vehicle cannot be specified by the data readout from the number plate.

5. Toll collection system comprising:

entrance data obtaining means for obtaining data showing that a vehicle has entered an entrance of a toll road and data obtained from an on board unit mounted on the vehicle by wireless communication as entrance passing data;

means for imposing toll charge for a specified section on the vehicle basing upon the obtained entrance passing data;

exit data obtaining means for obtaining data that the vehicle has passed from an exit of the toll road and data obtained from the on board unit by wireless communication as exit passing data; and settling means for specifying the vehicle basing upon the exit passing data and the entrance passing data obtained respectively and changing the imposed toll charge corresponding to the travelling distance and collecting the toll charge.

6. A system as claimed in claim 5, wherein the exit passing data includes data peculiar to the on board unit obtained by wireless communication with the on board unit.

7. A system as claimed in claim 6, wherein the exit data obtaining means includes:

means for obtaining data readout from a number plate provided on the vehicle; and the settling means includes:

means for specifying the vehicle basing upon the data readout from the number plate, in case the vehicle could not be specified basing upon the data peculiar to the on board unit included in the exit passing data and the entrance passing data respectively.

8. A system as claimed in claim 7, wherein the vehicle specifying means includes:

means for preparing abnormal cases details including data peculiar to the on board unit that is obtained from one of the exit passing data and the entrance passing data and transmitting the abnormal cases details to the entrance of the toll road when the vehicle cannot be specified by the data readout from the number plate.

9. A toll collection method comprising the steps of:

obtaining data showing that a vehicle has entered an entrance of a toll road and data obtained from an on board unit mounted on the vehicle by wireless communication as entrance passing data;

imposing toll charge for a specified section on the vehicle basing upon the obtained entrance passing data;

obtaining data that the vehicle has passed from an exit of the toll road and data obtained from the on board unit by wireless communication as exit passing data; and specifying the vehicle basing upon the exit passing data and the entrance passing data obtained respectively and changing the imposed toll charge corresponding to the travelling distance and collecting the toll charge.

10. A method as claimed in claim 9, wherein the exit passing data includes data peculiar to the on board unit obtained by wireless communication with the on boar unit.

11. A method as claimed in claim 10 further comprising the steps of:

obtaining data readout from a number plate provided on the vehicle; and specifying the vehicle basing upon the data obtained from the number plate when the vehicle cannot be specified by the data peculiar to the on board unit included in the exit passing data and the entrance passing data, respectively.

12. A method as claimed in claim 11 further comprising the step of:

preparing abnormal cases details including data peculiar to the on board unit that is obtained from one of the exit passing data and the entrance passing data and transmitting the abnormal cases details to the entrance of the toll road when the vehicle cannot be specified by the data readout from the number plate.

* * * * *